United States Patent [19]

Iannucci et al.

[11] Patent Number: 4,765,220

[45] Date of Patent: Aug. 23, 1988

[54] STRAND SUPPLY CARRIER AND TENSIONING MECHANISM

[75] Inventors: Vincent A. Iannucci, Westlawn; Rudolf H. Haehnel, Reading, both of Pa.

[73] Assignee: Rockwell International Corporation, Pittsburgh, Pa.

[21] Appl. No.: 100,851

[22] Filed: Sep. 25, 1987

[51] Int. Cl.[4] ..... D04C 3/18; B65H 59/04

[52] U.S. Cl. ..... 87/57; 87/22; 242/156.2

[58] Field of Search ..... 87/21, 22, 55–57; 242/129.8, 156, 156.2

[56] References Cited

U.S. PATENT DOCUMENTS

| | | | |
|---|---|---|---|
| 618,541 | 1/1899 | Janssen | 87/22 |
| 618,542 | 1/1899 | Janssen | 87/22 |
| 679,650 | 7/1901 | Turner | 87/57 |
| 694,536 | 3/1902 | Diss | 87/22 |
| 696,094 | 3/1902 | Diss | 87/22 X |
| 981,958 | 1/1911 | Wardell | 87/22 |
| 1,072,800 | 9/1913 | Wardwell | 87/22 |
| 1,442,432 | 1/1923 | Hooper | 87/22 |
| 2,166,336 | 7/1939 | Barningham | 87/22 |
| 2,258,018 | 10/1941 | King | 87/22 |
| 3,686,997 | 8/1972 | Strangfeld | 87/57 |
| 4,003,290 | 1/1977 | Haehnel et al. | 87/57 |

*Primary Examiner*—John Petrakes

[57] ABSTRACT

An improved strand supply carrier and tensioning mechanism which has yarn guides that are associated with a cantilevered tensioning spring of variable length, the spring having a strand guide wheel on the free end and a pawl to engage ratchet means to achieve strand let-off length that is essentially constant throughout the depletion of the strand package.

5 Claims, 1 Drawing Sheet

STRAND SUPPLY CARRIER AND TENSIONING MECHANISM

BACKGROUND OF THE INVENTION

Machinery which utilizes filamentary materials as part of a manufacturing process must take into account the physical capabilities of the filament being used. For example, braiding and winding equipment utilize strands which may be either wire or yarn. Depending upon the size and strength of the strand being used in any given application consideration must be given to such things as strand tension and length, uniformity of tension and the degree of strand abrasion which might occur during product formation. In braiding and winding the strand are usually present on strand bobbins or yarn packages from which they are payed out through some sort of strand guiding mechanism. The bobbins are mounted on carriers that are designed to permit controlled rotation of the bobbins as strands are payed out. Still, however, on most existing machines some slack occurs in the strand and this must be taken up by the guiding elements, which produces a harmful sawing on the strand.

DESCRIPTION OF THE PRIOR ART

There exists in the prior art a wide variety of carriers for braiding and winding machines that utilize ratchet and pawl mechanisms to control bobbin or package rotation.

An early example of a bobbin that is controlled by a ratchet and pawl mechanism is that shown in U.S. Pat. No. 618,542. Here, the head of bobbin C is formed with a ratchet and cooperates with pawl F to control the let off of yarn from the bobbin. It will be seen that as yarn is fed off of the bobbin it is fed around pulley wheel G which is carried on the tension weight block G. As tension in the yarn increases, the block moves upwardly in the stand into the dotted line position shown in FIG. 2 where the pin G' hits the end of pawl F and tilts the other end out of engagement with the teeth on the end of bobbin C.

A slightly different form of ratchet-pawl arrangement can be seen in U.S. Pat. No. 1,442,432 where the bobbin is provided with a ratchet toothed gear 10 that is secure to its upper end. In this case, as the yarn tension is increased, the springs 30 yield and a cam surface 39 moves upwardly until it engages the heel 21 of pawl 12. When this happens, the pawl disengages from the ratchet and permits the bobbin to rotate and pay out yarn.

Other ratchet and pawl arrangements for controlling the lead off of yarn or strand bobbins may be found by referring to U.S. Pat. Nos. 696,094 1,072,800 2,166,336 and 2,258,018. It should be noted that in each case the construction and operation of these control mechanisms is such that yarn tension cannot be retained at a substantially constant level and that in most cases, some sawing of the strand occurs at the guide eyelet.

SUMMARY OF THE INVENTION

The carrier of the present invention is designed to be operated in conjunction with yarn or wire operating at low tensions and at constant lengths. The tensions are maintained at a substantially constant level since the distance from the carrier to the braid point is substantially constant during operation of the braiding machine. Additionally, since the distance is substantially constant elimination of any sawing action on the yarn or wire is completely eliminated.

It is a principal object of this invention to provide an improved carrier of simplified construction which is effective where substantially constant length of strand from the carrier to the braid point.

It is another object of this invention to provide an improved carrier in which the operating tension can be varied simply and over a fairly broad range.

Other objects and advantages of this invention will be in part obvious and in part explained by reference to the accompanying specification and drawings in which:

FIG. 1 is a side elevation of the carrier of this invention with a strand package mounted in the usual operating position; and FIG. 2 is a top elevation with a portion of the package broken away to illustrate the way in which the pawl and ratchet mechanism cooperate.

DESCRIPTION OF THE PREFERRED EMBODIMENT

Figure 1:
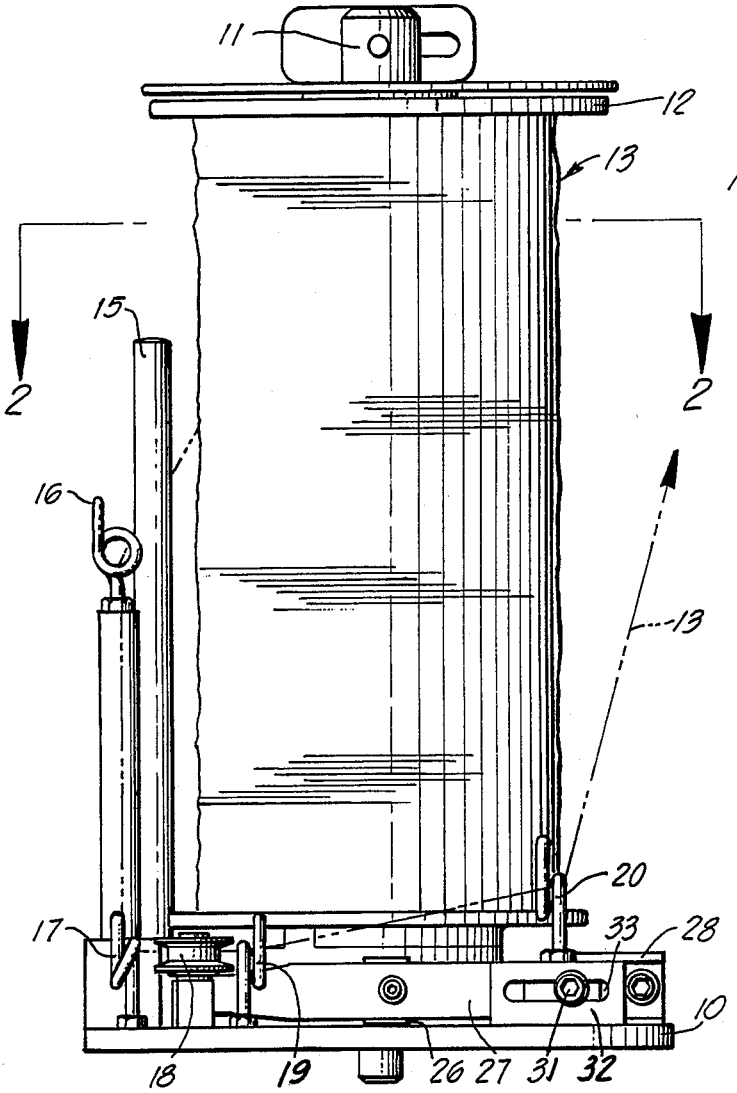
Figure 2:
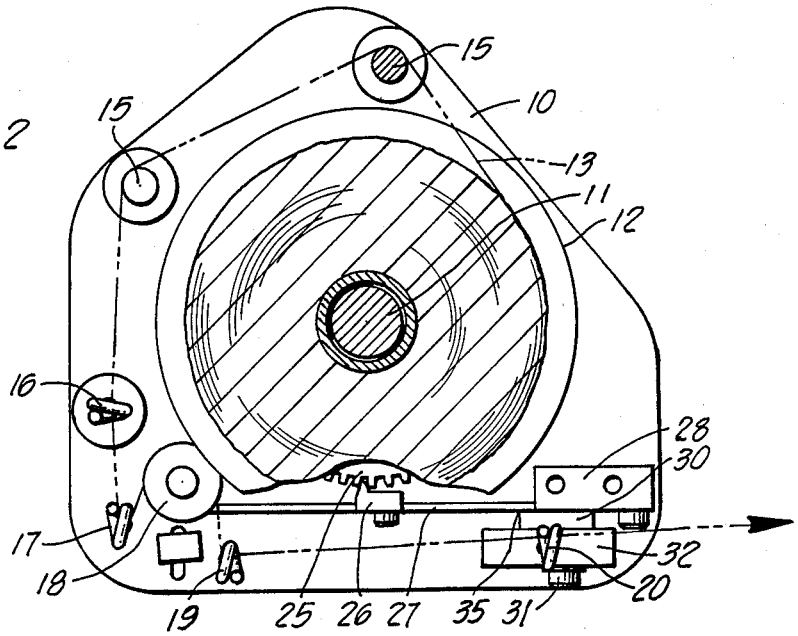

To better understand the carrier design of this invention, reference is made to the drawings in which numeral 10 indicates the carrier base. Supported on and extending outwardly from base 10 is a vertical bobbin post 11 which is adapted to receive a bobbin 12. The bobbin contains a supply of yarn or wire, which will hereinafter be referred to in all instances as strand 13. On the bottom next to the base and connected to the lower flange of the bobbin is a ratchet 25 (or multi-toothed detent) which is supported by an anti-friction bearing (not shown) located on the bobbin post center. As the strand supply, that is the bobbin, rotates in a counter-clockwise direction it lets off strand to the machine. The strand travels over two bailer bars 15 to a pigtail 16 which is located vertically at the center of the bobbin traverse length. The strand is then directed downwardly toward the carrier base and through a second pigtail 17. The strand is next threaded around a strand roller 18 and forwardly to a third pigtail 19. It will thus be noted that pigtails 17 and 19 are located or supported on base 10 and located on each side and rearwardly of guide wheel or strand roller 18 whereby the direction of the force created in the strand roller by the strand is substantially normal to the fulcrum line of the tensioning leaf spring described below. After leaving the third pigtail 19 the strand then passes through the final and fourth pigtail 20 from where it is directed toward the braid point if it is an inner carrier or to the actuator arm mechanism and further to the braid point if an outer carrier.

The let off mechanism consists of ratchet 25 which, as previously mentioned, is supported by an anti-friction bearing located on the bobbin post center, a pawl 26 and a leaf spring 27 to which the pawl 26 and strand roller 18 are attached. Leaf spring 27 is fixed to a stationary block 28 mounted to carrier base 10 and further supported in the direction of spring deflection by a fulcrum block 30 which is adjustable in location along spring 27 by means of a threaded fastener 31. Fastener 31 extends through the support 32 of pigtail 20 through a slot 33 and secures into the mounting block 28. It can be seen that as fulcrum block 30 is moved back and forth, the fulcrum line 35 of spring 27 can be varied so that the effective length of the spring can be changed to require greater or lesser amounts of tension in the strand to effect movement of pawl 26 away from ratchet mechanism 25.

With this mechanism, tensioning can not only be varied by altering the position of block 30 but can also be effected by a selection of leaf springs. That is, different ranges of tension can be obtained by using leaf springs of different thicknesses. Further adjustment of tensioning can be effected by threading from the strand roller directly to pigtail 20, this action reducing the force component deflecting the leaf spring and thereby raising the range of strand tension settings obtainable with a given leaf spring and support configuration. The above described simple carrier design is possible because the combined principles of rotary braiding and an essentially constant strand length for outer carriers permits using a carrier with minimal compensating properties. The integration of the pawl, spring loading member, and threading path (strand roller) into one member permits a low inertia member to operate at high response with a ratchet having a relatively higher number of teeth than normally employed on ratchet carriers.

Since the let off tension is independent of strand package diameter, strand tension is essentially constant throughout the depletion of the strand package. This carrier operates, causing minimal strand damage.

We claim:

1. A strand supply carrier and tensioning mechanism for holding a strand supply bobbin comprising:

(a) a base;

(b) a bobbin post supported on and extending outwardly from said base to receive a bobbin;

(c) toothed ratchet means journaled on said bobbin post for operative connection to a bobbin;

(d) strand tensioning means including:

(i) an elongated leaf spring;

(ii) means including a fulcrum block supporting one end of said leaf spring on said base, (iii) a strand guide wheel mounted on that end of said leaf spring opposite the end supported on said base, and (iv) a pawl mounted on said leaf spring between said fulcrum block and said strand guide wheel for engagement with the teeth on said ratchet, and (e) strand guide means for guiding strand from the bobbin to and away from said guide wheel.

2. A strand supply carrier and tensioning mechanism as defined in claim 1 wherein means are provided to adjustably position said fulcrum block at different locations along the length of said leaf spring and thereby change the force required to effect deflection of said spring.

3. A strand supply and tensioning mechanism as defined in claim 2 wherein said means adjustably positioning said fulcrum block comprises two mounting brackets attached to said base on each side of said fulcrum block, means defining an elongated slot in said fulcrum block and fastening means extending through said fulcrum block and between said two mounting brackets to adjustably clamp said fulcrum block.

4. A strand supply and tensioning mechanism as defined in claim 1 wherein said strand guide means includes a guide element support on said base and located on each side of and rearwardly of said guide wheel whereby the direction of the force created in said guide wheel by the strand is substantially normal to the fulcrum line of said leaf spring.

5. A strand supply and tensioning mechanism as defined in claim 4 wherein means are provided to present strand to and remove it from said guide wheel at substantially the same elevation as the center of said guide wheel.

* * * * *